US005450705A

United States Patent [19]

Gatteschi

[11] Patent Number: 5,450,705

[45] Date of Patent: Sep. 19, 1995

[54] CARTONING MACHINE FOR WRAPPING CARTONS ABOUT OBJECTS AT HIGH SPEED

[75] Inventor: Emanuele Gatteschi, Parma, Italy

[73] Assignee: OCME S.r.l., Parma, Italy

[21] Appl. No.: 290,033

[22] Filed: Aug. 12, 1994

[30] Foreign Application Priority Data

Aug. 30, 1993 [IT] Italy ..... MI92A1863

[51] Int. Cl.[6] ..... B65B 11/12

[52] U.S. Cl. ..... 53/228; 53/207

[58] Field of Search ..... 53/228, 231, 230, 207, 53/462, 466, 534, 558, 77

[56] References Cited

U.S. PATENT DOCUMENTS

| | | | |
|---|---|---|---|
| 3,618,740 | 11/1971 | Taverna | 53/228 X |
| 4,574,565 | 3/1986 | Gambetti | 53/228 X |
| 4,631,895 | 12/1986 | Ghiretti et al. | 53/207 |
| 4,706,444 | 11/1987 | Gambetti | 53/228 X |
| 4,881,357 | 11/1989 | Ballestrazzi et al. | 53/228 X |

FOREIGN PATENT DOCUMENTS

| | | |
|---|---|---|
| 486062 | 4/1969 | Germany . |
| 158036 | 11/1985 | United Kingdom . |

OTHER PUBLICATIONS

European Search Report, The Hague, Nov. 28, 1994, Examiner: A. Hagberg.

*Primary Examiner*—James F. Coan

*Attorney, Agent, or Firm*—Hedman, Gibson & Costigan

[57] ABSTRACT

A cartoning machine for wrapping cartons about objects at high speed, consisting of a series of stations arranged one after the other on a frame and comprising a conveying table which feeds objects to a station for separating said objects into groups and to a pusher conveyor for the groups, below the pusher conveyor there being located a further conveyor for feeding cartons in an open and flat state towards an aperture provided in an advancement table for the group of objects, deflector elements being positioned in correspondence with the aperture to deviate the carton upwards within the pusher conveyor, wherein the further conveyor is arranged inclined from the bottom upwards and can rotate about a pivot under the action of control elements so that the upper end of the further conveyor is always directed towards the aperture, which can be moved forwards and rearwards along the advancement table in phase with the end of the further conveyor.

8 Claims, 4 Drawing Sheets

CARTONING MACHINE FOR WRAPPING CARTONS ABOUT OBJECTS AT HIGH SPEED

This invention relates to a cartoning machine for wrapping cartons about objects at high speed.

Cartoning machines of automatic operation are currently used for cartoning or packaging single objects or groups of objects such as bottles, cans etc. in a pre-punched carton formable into a box. In these machines the objects, usually arriving from an accumulation conveyor, are divided into the desired number and arrangement in a dividing station. When arranged, they are conveyed into a subsequent station for insertion into the pre-punched carton before being finally closed into its interior by folding and gluing the carton arranged about the objects.

In known machines, downstream of the separation station there is a conveyor consisting of transverse bars arranged on endless chains, at which there is located a feed conveyor for the pre-punched cartons. This conveyor is provided in the lower part of the machine and is inclined towards an aperture provided in the table along which the objects travel.

One or more deflector elements cause the carton to emerge from said aperture in such a manner that it is deviated upwards to facilitate its arrangement about the group of objects. In this respect, the deflector elements both cause the carton to emerge from the aperture and cause it to fold about preferential creasing lines provided on it to define its walls.

In known machines there are limits to the cartoning rate in that the deflector elements have to be suitably correlated with the product advancement. In this respect, when the deflector elements have deviated a first carton onto a first group of objects and have then been retracted below the product advancement table, they have to wait for the end of the wall of the first carton before again rising to halt and deviate a second carton.

To achieve this the transverse bars, arranged on the chains and acting as pusher elements, have to be positioned a large distance apart, their positioning limiting the machine speed.

The object of the present invention is to provide a cartoning machine for wrapping cartons about objects which is able to operate at high speed, so reducing packaging time while still ensuring correct positioning of the objects within the cartons. This object is achieved according to the present invention by a cartoning machine for wrapping cartons about objects at high speed, consisting of a series of stations or units arranged one after the other on a frame and comprising a conveying table which feeds objects in general to a station for separating or dividing said objects into groups and to a pusher conveyor for said separate groups of objects, below said pusher conveyor there being located a further conveyor for feeding pre-punched cartons in a completely open and flat state towards an aperture provided in an advancement table for said group of objects, deflector elements being positioned in correspondence with said aperture to deviate said pre-punched carton upwards within said pusher conveyor, characterised in that said further conveyor is arranged inclined from the bottom upwards and can rotate about a pivot under the action of control elements so that the upper end of said further conveyor is always directed towards said aperture, said aperture being movable forwards and rearwards along said advancement table in phase with said end of said further conveyor.

The characteristics and advantages of a cartoning machine according to the present invention will be more apparent on reading the description of one embodiment thereof given by way of non-limiting example with reference to the accompanying schematic drawings, in which.

Figure 1:
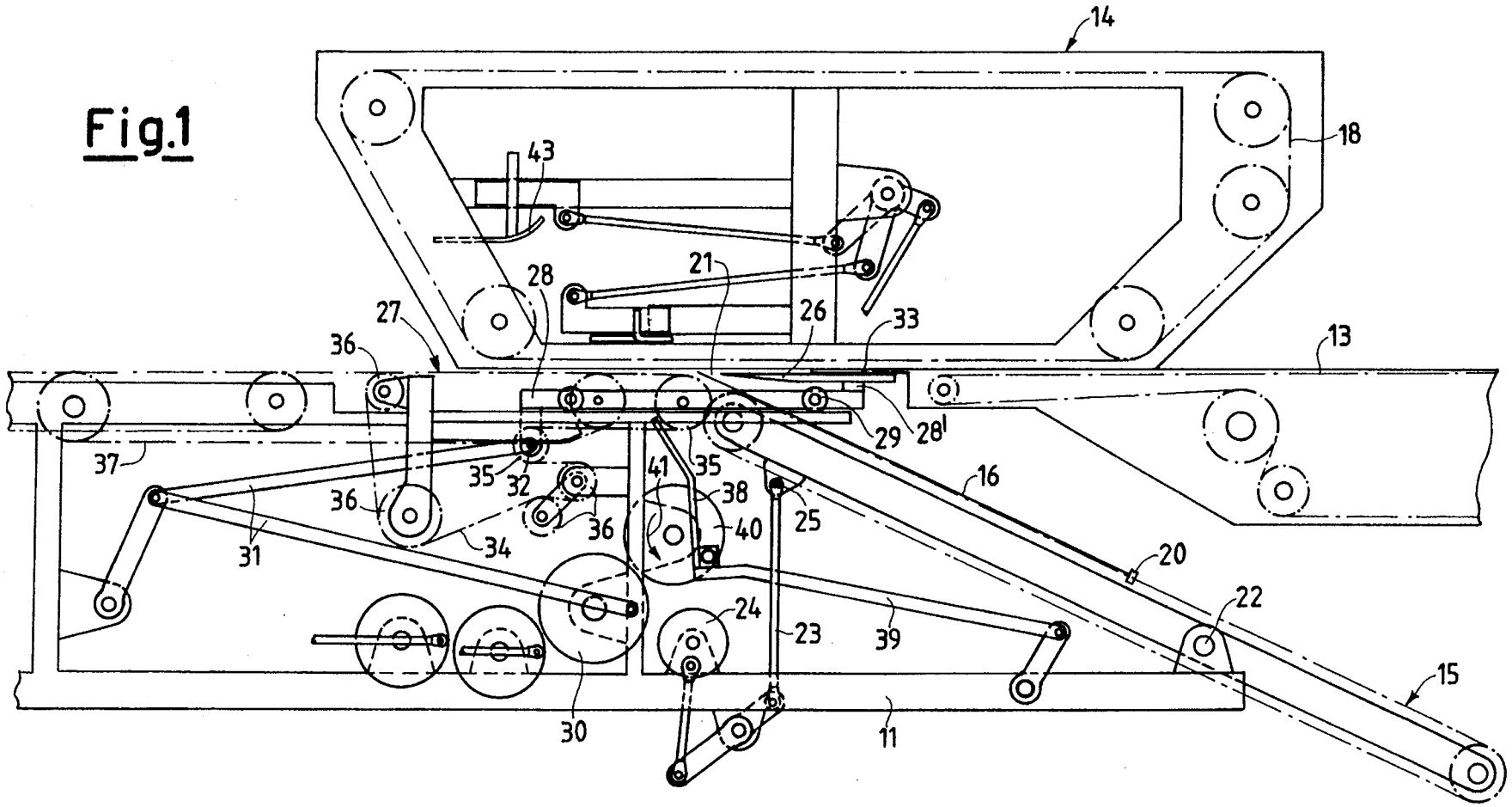
FIG. 1 is an elevational view of a cartoning machine with only its central stations shown.

A cartoning machine for wrapping cartons about objects according to the present invention consists of a series of stations or units arranged one after the other.

In this respect, an accumulation conveyor feeding objects 12 such as bottles, cans, containers in general etc. towards a station or unit for their separation or division into groups is usually provided on a frame schematically shown at 11. The groups divided in this manner and supported on a final part of a conveying table 13 are made to advance along the advancement table at a suitable distance apart towards the actual cartoning region by a pusher conveyor 14.

Within the frame 11 below the pusher conveyor unit 14 there is located a further conveyor 15 for feeding pre-punched cartons 16 in a completely open and flat state. Finally, after an individual carton 16 has been folded and formed into a box, devices are provided for gluing and pressing the edges of the carton 16 to complete the packaging of the objects 12 and the formation of the box.

The accumulation conveyor, not shown, consists for example of a first belt with which the unit for separation into groups is combined, this latter consisting of a second belt provided with separation elements. These separation elements are suitably spaced apart and emerge within the first belt to define predetermined groups of objects 12.

The objects thus separated into groups, indicated overall by 17, are fed by the conveying table 13 to the pusher conveyor 14 consisting of chains 18 carrying transverse bars 19. The transverse bars 19 are arranged in succession suitably spaced apart and act as pusher elements for the groups 17 of objects 12. According to the present invention, below the pusher conveyor 14 there is positioned a further conveyor 15 which feeds the pre-punched cartons 16 one after the other in a completely open and extended state. The conveyor 15 carries at least one pusher element 20 which urges and feeds the cartons 16 towards an aperture 21 provided in the advancement table for the groups 17 of objects 12.

The conveyor 15 is positioned inclined from the bottom upwards and can rotate about a pivot 22. The downward and upward rotating movement of the conveyor 15 is suitably controlled by levers 23 operated by an eccentric drive at 24 and pivoted to the top of the conveyor structure at 25. In this manner the upper end of the conveyor 15 is directed alternately at a predetermined frequency towards different points of the advancement table for the groups of objects.

It should be noted that according to the present invention the upper end of the conveyor 15 is always in a position corresponding with said aperture 21. In this respect the aperture 21 also varies in position along the advancement table as it consists of a pair of surfaces 26 and 27 arranged in succession and both movable along the advancement table forwards and rearwards with reciprocating movement.

Both the surfaces 26 and 27 are arranged on a carriage 28 slidable on the frame 11 via wheels 29. The carriage 28 is also driven forwards and rearwards with reciprocating movement by a crank 30 to which there is connected a lever system 31 pivoted to the carriage at 32.

The first surface 26, positioned upstream of the aperture 21, is formed by a plate carried by a cross-member 28' of the carriage 28 and slidable below a rigid end part 33 of the conveying table 13.

The second surface 27, positioned downstream of the aperture 21, is formed by a group of chains 34 which pass both about sprockets 35 positioned on the carriage 28 and about sprockets 36 rotatably rigid with the frame 11.

Centrally to said chains 34 there is also positioned a chain 37 which provides for evacuating the groups 17 of objects when associated with the relative carton 16.

In a region below the surfaces 26 and 27 in correspondence with the aperture 21, there are provided deflector elements 38 which deviate the pre-punched carton 16 upwards within the separation unit 14. The deflector elements 38 are arranged at one end of a bar 39 operated by a cam lever system 40 to move along a path of elliptical type.

At the exit of this latter unit 14 there are provided elements for accompanying the flaps of the carton 16, they being shown schematically at 43, for causing it to wrap about each group of objects.

Figure 2:
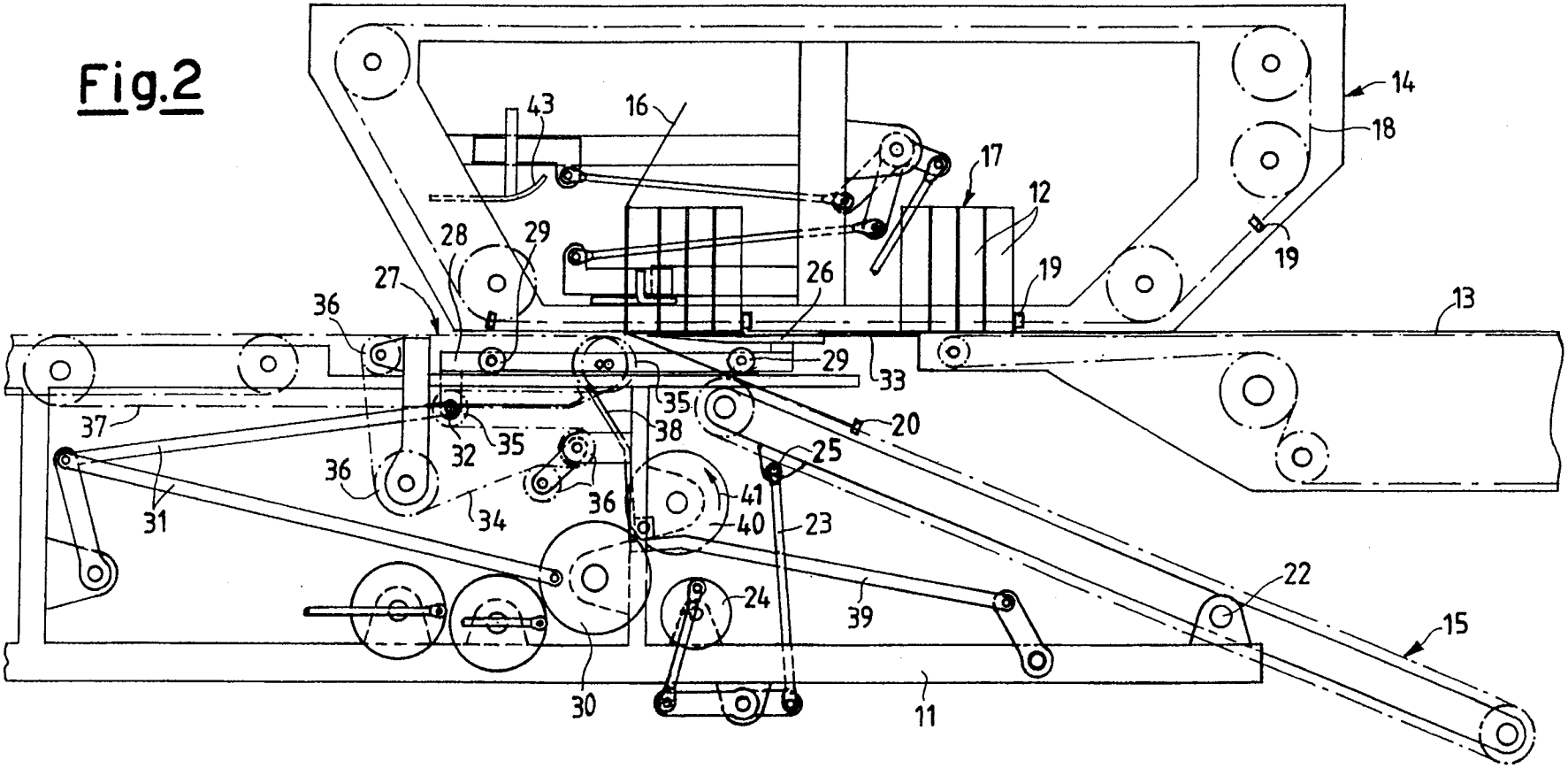
FIG. 2 is an elevational view similar to FIG. 1 but showing a further position of the machine.
Figure 3:
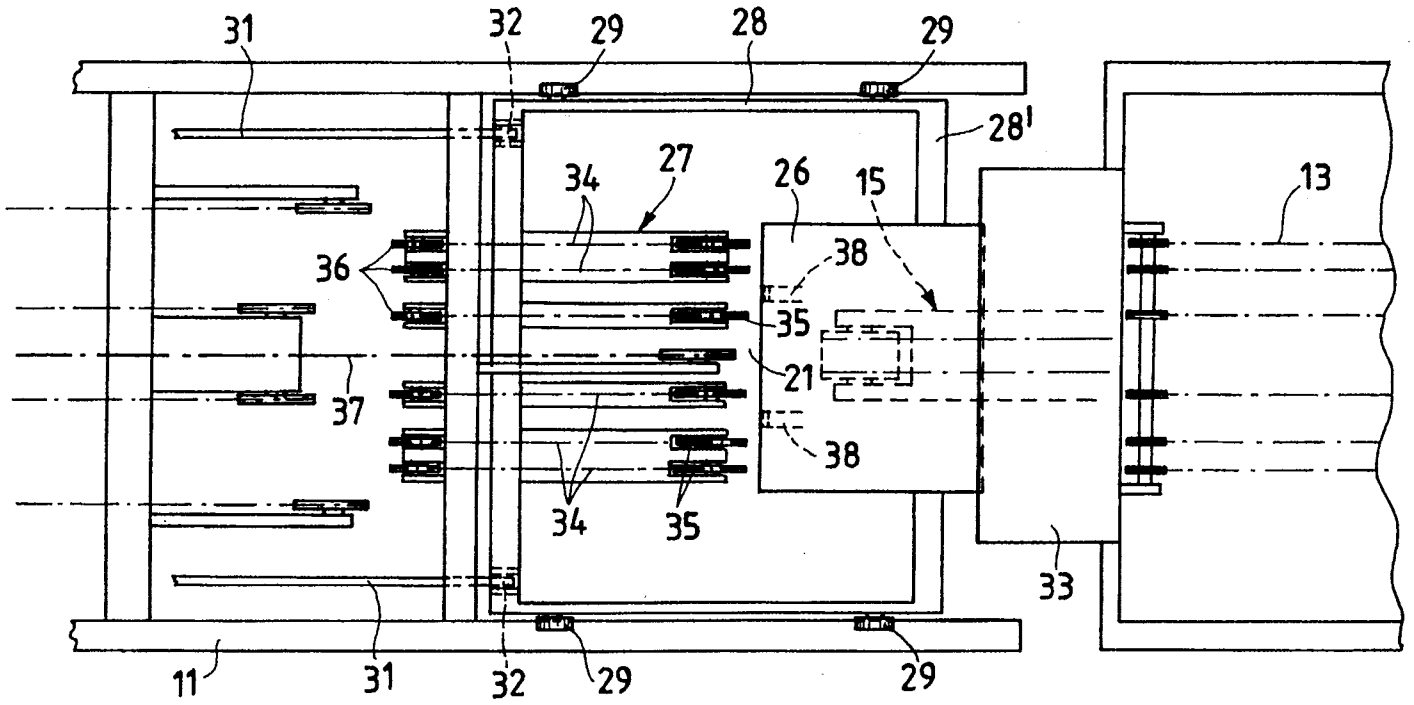
FIG. 3 is a detailed plan view of the region in which the objects are separated and cartoned, and the pre-punched cartons fed one after the other.

FIGS. 1 and 2 show the end positions assumed by the aperture 21 during the operation of the cartoning machine. For a better understanding of this operation reference will be made to FIGS. 4 to 8.

When by means of its initial stations the cartoning machine has separated the objects 12 into groups 17 of a predetermined number, these groups are advanced along the machine by the bars 19 acting along the rigid end part 33 of the conveying table 13.

During a first stage the further conveyor 15 is in its position of maximum raising as shown in FIG. 1, with a pre-punched carton 16 at its top. The deflector elements 38 are well below the objects to be cartoned.

Figure 4:
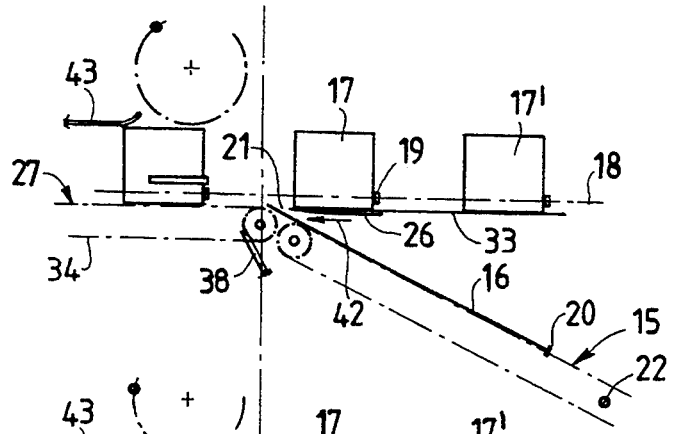
FIGS. 4 to 8 show successive operating stages of the machine according to the present invention.

In a second stage, shown in FIG. 4, movement correlation commences such that the carton 16 is always in the direction of the aperture 21 which moves along the advancement table for the groups of objects. The arrangements of the various parts are similar to those shown in FIG. 1.

Figure 5:
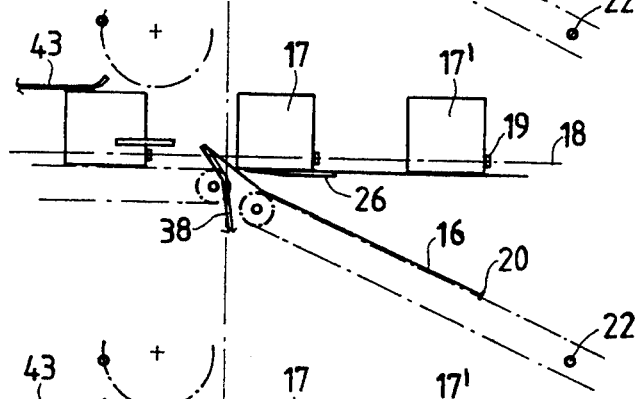

In a third stage, shown schematically in FIG. 5, the group 17 of objects is pushed further forwards by the bar 19. Simultaneously the deflector elements 38, raised by the rotation of the cam lever system 40 in the direction indicated by the arrow 41, deviate upwards the upper initial part of the carton 16 urged by the conveyor 15.

It should be noted that in this third stage the aperture 21 from which the carton 16 emerges has further moved in the direction of the arrow 42 of FIG. 5 because of the movement of the carriage 28 supporting the surfaces 26 and 27. In addition the conveyor 15 has been further rotated about the pivot 22 so as to maintain the feed direction of the carton 16 aligned with the aperture 21.

Figure 6:
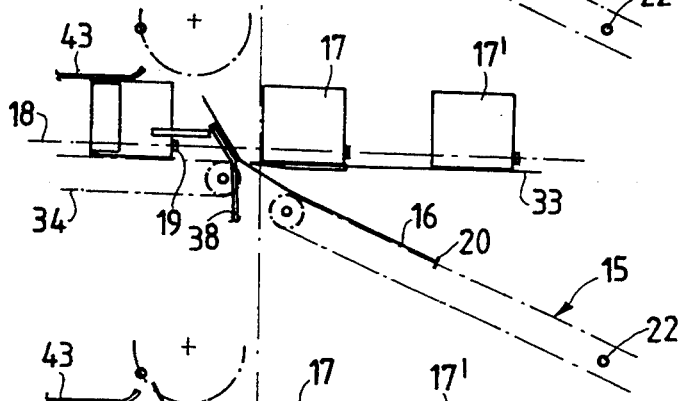

In a fourth stage, shown in FIG. 6, the movement of the carriage 28 and rotation of the conveyor 15 continues, together with further advancement of the group 17 of objects. During this stage the deflector elements 38 reach their position of maximum raising, continuing to deviate the carton upwards.

Figure 7:
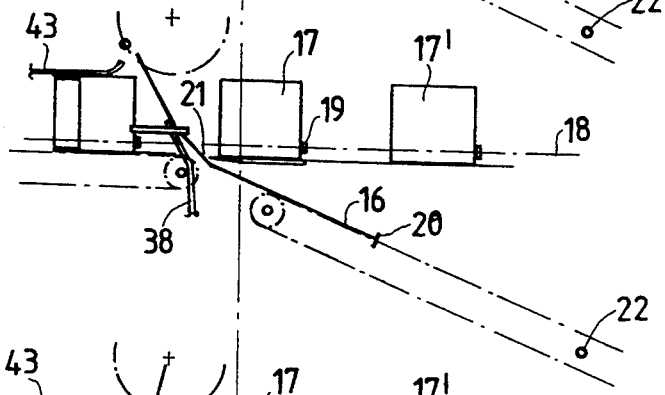

In the next stage shown in FIG. 7, the group of objects is partly on the first surface 26, which is partly extracted from the rigid end part 33 of the conveying table 13. The carton 16 continues to be pushed out of the aperture by the pusher element 20 of the conveyor 15 and continues to be deviated upwards by the relative deflector elements 38, which are being lowered.

Figure 8:
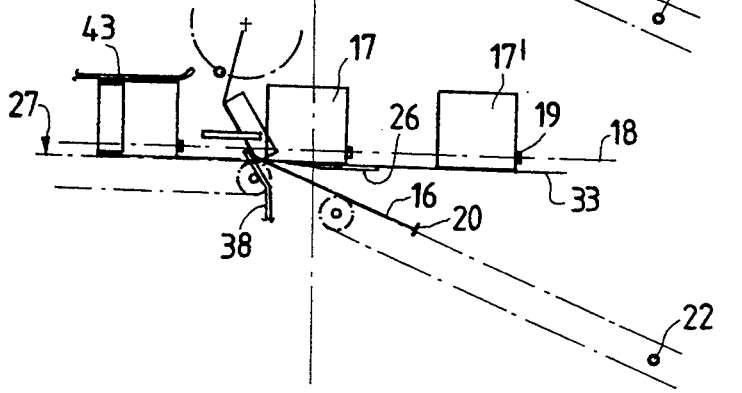

FIG. 8 shows a subsequent stage in which two flaps of the carton 16 have almost completely emerged from the aperture 21 and are urged by the accompanying elements 43 to wrap the group 17 of objects.

FIG. 2 shows the completion of rotation of the conveyor 15 in one direction and the completion of advancement of the carriage 28. One half of the carton 16 almost completely wraps the group of objects, and the deflector elements have already disappeared below the advancement table.

The next operating stage of the machine consists of inversion both of the rotation of the conveyor and of the movement of the carriage so that the aperture 21 tends to move rearwards along the advancement table.

The end part of the carton 16, resting on the chains 34 forming the second surface 27, is then raised and becomes positioned below the plate 26 forming the first surface.

In this manner the end part of the carton 16 in no way disturbs the various constituent elements of the machine units. In this respect, being positioned below the first surface 26 it enables a further group 17' of objects to be advanced, even if lying only a short distance from the first said group 17. This arrangement of the end part of the carton 16 does not interfere with the upper end of the deflector elements 42, which can hence be immediately raised to deviate the pre-punched carton upwards. This next pre-punched carton 16 can consequently be immediately fed towards the aperture 21 without encountering any obstacle.

Hence with a cartoning machine of the present invention, the machine pitch, ie the distance between one pusher 19 and the next, can be advantageously reduced, hence increasing the exit package rate for the same linear speed of the pushers.

The constituent stations or units of the cartoning machine can be operated mechanically or by separate motors controlled by suitable sensors correlated by a computer or the like.

If only mechanical correlation is provided, a series of transmissions can be used obtaining their movement from a central drive by way of deviators and reduction gears for the various units.

If however separate motors are provided, devices such as encoders or the like can be combined with the various units to identify individual positions in time, and to transmit relative signals. These signals, suitably compared with a predetermined program, then determine the operation or non-operation of the motors of the various units.

I claim:

1. A cartoning machine for wrapping cartons about objects at high speed, consisting of a series of stations or units arranged one after the other on a frame and comprising a conveying table which feeds objects in general to a station for separating or dividing said objects into groups and to a pusher conveyor for said separate groups of objects, below said pusher conveyor there being located a further conveyor for feeding pre-punched cartons in a completely open and flat state towards an aperture provided in an advancement table for said group of objects, deflector elements being positioned in correspondence with said aperture to deviate said pre-punched carton upwards within said pusher conveyor, characterised in that said further conveyor is arranged inclined from the bottom upwards and can rotate about a pivot under the action of control elements so that the upper end of said further conveyor is always directed towards said aperture, said aperture being movable forwards and rearwards along said advancement table in phase with said end of said further conveyor.

2. A machine as claimed in claim 1, characterised in that said aperture, variable in position along said advancement table, consists of a pair of surfaces arranged in succession and both movable forwards and rearwards along the advancement table with reciprocating movement.

3. A machine as claimed in claim 2, characterised in that said pair of surfaces are arranged on a carriage, a first surface upstream of said aperture being formed by a plate and the second surface downstream of said aperture being formed by a plurality of side-by-side, spaced-apart chains.

4. A machine as claimed in claim 3, characterised in that said carriage is caused to move reciprocatingly forwards and rearwards by a lever system connected to a motorized crank.

5. A machine as claimed in claim 1, characterised in that said further conveyor for feeding cartons is pivoted in an intermediate region to said frame and is connected by a lever system to an eccentric drive.

6. A machine as claimed in claim 1, characterised in that said deflector elements are operated by a lever-cam system.

7. A machine as claimed in claim 1, characterised in that said series of stations are interconnected by a series of transmissions driven by a central drive.

8. A machine as claimed in claim 1, characterised in that each of said series of stations is provided with separate motors, sensors being associated with said stations to identify individual positions in time and to transmit relative signals to a computer which selectively controls the operation of said motors on the basis of a predetermined program.

* * * * *